US006183352B1

(12) United States Patent
Kurisawa

(10) Patent No.: US 6,183,352 B1
(45) Date of Patent: Feb. 6, 2001

(54) SLURRY RECYCLING APPARATUS AND SLURRY RECYCLING METHOD FOR CHEMICAL-MECHANICAL POLISHING TECHNIQUE

(75) Inventor: Shuu Kurisawa, Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/382,640

(22) Filed: Aug. 25, 1999

(30) Foreign Application Priority Data

Aug. 28, 1998 (JP) ..... 10-244124

(51) Int. Cl.[7] ..... B24C 9/00

(52) U.S. Cl. ..... 451/87; 451/36; 451/60; 451/88; 451/99; 451/446; 451/447; 210/107; 210/96.1; 210/416.1; 210/739

(58) Field of Search ..... 451/36, 60, 87, 451/88, 99, 446, 447; 210/167, 96.1, 416.1, 739

(56) References Cited

U.S. PATENT DOCUMENTS 5,664,990 * 9/1997 Adams et al. ..... 451/60
5,755,614 5/1998 Adams, et al. .
5,791,970 * 8/1998 Yueh ..... 451/8
5,846,398 12/1998 Carpio .
6,048,256 * 4/2000 Obeng et al. ..... 451/60

FOREIGN PATENT DOCUMENTS 2-257627 10/1990 (JP) .
5-49257 6/1993 (JP) .
10-58314 3/1998 (JP) .
10-118899 5/1998 (JP) .

OTHER PUBLICATIONS

British Search Report dated Apr. 13, 2000.

* cited by examiner

*Primary Examiner*—Stephen F. Gerrity
*Assistant Examiner*—Shantese McDonald
(74) *Attorney, Agent, or Firm*—McGinn & Gibb, P.C.

(57) ABSTRACT

A first pump collects used slurry which is employed for a CMP technique. A new slurry supply device supplies new slurry having a concentration higher than a concentration of the used slurry, to the used slurry. A sensor measures a concentration of recycled slurry produced by mixing the used slurry with the new slurry. The new slurry supply device stops supplying the new slurry, in a case where the concentration which the sensor measures is equal to or above a predetermined value. A second pump supplies recycled slurry onto a polishing stage, after the used slurry is completely recycled.

15 Claims, 6 Drawing Sheets

SLURRY RECYCLING APPARATUS AND SLURRY RECYCLING METHOD FOR CHEMICAL-MECHANICAL POLISHING TECHNIQUE

BACKGROUND OF THE INVENTION

1. Field of the Invention

The present invention relates to a slurry recycling apparatus and method for a chemical-mechanical polishing technique (hereinafter referred to as a CMP technique).

2. Description of the Related Art

A CMP technique is employed for polishing semiconductor wafers and for obtaining planer surfaces thereof.

To polish an object (particularly, the semiconductor wafer, etc.) with the CMP technique, the object is pressed against a polishing pad, and the object and the polishing pad are rotated and moved relatively. A chemical solution, that is, slurry for polishing is supplied onto the polishing pad so as the object to be polished.

A by-product, and changes in a chemical composition and a pH of the slurry which are produced and caused during the polishing process entail a drawback that the object is not satisfactorily polished. Therefore, slurry which has optimum chemical properties such as concentration, pH, etc. needs to be supplied onto the polishing pad.

For the above-described reasons, new slurry is always supplied onto the polishing pad, resulting in consuming a large amount of slurry. However, slurry is expensive, therefore, various techniques have been proposed for recycling used slurry.

In the technique disclosed in Unexamined Japanese Patent Application No. H2-257627, the slurry is recycled by an apparatus having a structure shown in FIG. 5.

As shown in FIG. 5, slurry used in a polisher 101 is collected into a tank 103 via a tube 102. After silica contained in the used slurry is removed therefrom by a centrifugal separator 104 connected to the tank 103, the slurry is supplied back to the tank 103.

In order to recycle the used slurry, undiluted slurry having a high concentration is supplied into the tank 103 from an undiluted slurry tank 105, whereas water, etc., is supplied from a solvent tank 106 into the tank 103. An amount of undiluted slurry and water, etc., to be supplied is controlled based on a concentration of the slurry in the tank 103. The concentration of the slurry in the tank 103 is measured by a ultrasonic propagation speed measuring device 107. The slurry recycled within the tank 103 is supplied to the polisher 101 via a tube 109 by a pump 108.

In the technique disclosed in Unexamined Japanese Utility Model Application KOKAI Publication No. H5-49257, the used slurry is collected into a recycled fluid storage tank. In this case, a flow rate and a concentration of the used slurry are measured. Based on this measured result, an amount of coolant (a surface-active agent, a rustproof agent, a fluid addition agent, etc.) is supplied into the recycled fluid storage tank. Hence, the used slurry is recycled in the recycled fluid storage tank, and the recycled slurry is supplied therefrom to a polisher.

In the technique disclosed in Japanese Patent Application No. H10-58314, the slurry is recycled by an apparatus having the structure shown in FIG. 6.

A semiconductor wafer is placed with force on a polishing pad 201 and is made to rotate by a carrier 203 which is mounted with a shaft 202. Slurry 204 is supplied onto the polishing pad 201 from a tube 205 and is applied to polish the semiconductor wafer so as to be caught by a catch ring 206. The used slurry caught by the catch ring 206 is collected in a manifold 208 via a tube 207. New slurry is supplied into the manifold 208 via a tube 209, chemical components for recycling is supplied via a tube 210 and nonionic water is supplied via a tube 211. The new slurry, chemical components and nonionic water are added to the used slurry in the manifold 208 so as the slurry to be recycled.

The recycled slurry heats up or cools down at a predetermined temperature by a heat switcher 212. Afterward, the recycled slurry is measured and analyzed by sensors 213 to 215. An amount of new slurry, chemical components and nonionic water to be supplied is controlled by the measured and analyzed results of the sensors 213 to 215.

Further, the recycled slurry is filtered by a filter 216 and supplied onto the polishing pad 201 via the tube 205.

In the technique disclosed in Unexamined Japanese Patent Application KOKAI Publication No. H10-118899, the used slurry is concentrated by means of a ultrafiltration (UF) unit employing a ultrafilter. In such a case, a concentration of the concentrated slurry is measured, and if the concentration thereof is equal to or above a predetermined value, an alkali agent or an acid is added to the concentrated slurry. The used slurry which has been recycled in such a manner is once stored in a polishing agent bath and supplied to a polishing apparatus.

However, the above-described techniques entail problems described below.

According to the technique disclosed in Unexamined Japanese Patent Application KOKAI Publication No. H2-257627, there is provided a single tank (tank 103) for collecting the used slurry. Thus, while the used slurry is being recycled, more used slurry is continuously supplied into the tank 103. That is, collection of the used slurry and adjusting (recycling) the concentration of the slurry are parallelly and continuously performed. Accordingly, the used slurry and the centrifuged slurry each having various concentrations exist within the tank 103. This causes a drawback that adjusting the concentration of the slurry delays and the concentration thereof is hardly stable.

In addition to the above, the slurry is supplied to the polisher 101 from the tank 103 containing the used slurry together with the recycled slurry, that is, adjusting the concentration of the slurry (recycling the slurry) and supplying the slurry are parallelly and continuously performed. Hence, the slurry which has not been satisfactorily recycled may be supplied to the polisher 101, therefore, the to-be-polished object is polished with a low degree of accuracy.

In the technique disclosed in Unexamined Japanese Utility Model Application KOKAI Publication No. H5-49257, the flow rate and the concentration of the slurry to be supplied into the recycled fluid storage tank are measured, however, the concentration of the slurry recycled in the recycled storage tank is not measured. As a result of this, the concentration of the recycled slurry is not recognized. That is, even if the concentration of the recycled slurry does not satisfy a predetermined value, the slurry concentration value is not detected. Therefore, the concentration of the slurry may become unstable.

In the technique disclosed in Unexamined Japanese Patent Application KOKAI Publication No. H10-58314, each amount of new slurry, chemical components and nonionic water to be supplied into the manifold 208 is adjusted on the basis of the chemical properties and the concentration of the already-recycled slurry. However, the concentration of the slurry to be collected into the manifold 208 from the catch ring 206 is not constant, so that the concentration and the chemical properties of the to-be-recycled slurry are not stable. Accordingly, the to-be-polished object may not be preferably polished.

In the technique disclosed in Unexamined Japanese Patent Application KOKAI Publication No. H10-118899, the used slurry is concentrated by means of the ultrafiltration unit, thus, the alkali agent contained in the slurry is removed. Thus, the alkali agent needs to be added to the concentrated slurry, and it is required to arrange an apparatus for monitoring the addition amount, etc. This entails a problem that the structure of the recycling apparatus becomes comnplicated.

The recycled slurry is once collected in the polishing agent bath, and its concentration is not checked therein. The concentration of the slurry supplied to the polisher changes, without being detected. Therefore, the to-be-polished object may not preferably be polished.

SUMMARY OF THE INVENTION

Accordingly, an object of the present invention is to provide a slurry recycling apparatus for a CMP technique capable of providing, to a polishing apparatus, slurry having an optimum concentration and chemical properties.

Another object of the present invention is to provide a slurry recycling method for a CMP technique capable of recycling slurry having an optimum concentration and chemical properties for polishing chemical machines.

In order to achieve the above-described objects, according to the first aspect of the present invention, there is provided a slurry recycling apparatus for a CMP technique, comprising:

a first pump which collects used slurry employed for the CMP technique;

a new slurry supply device which supplies, from a CMP apparatus to the used slurry, new slurry having a concentration higher than a concentration of the used slurry;

a sensor which measures a concentration of recycled slurry produced by mixing the used slurry together with the new slurry; and a second pump which supplies the recycled slurry to the CMP apparatus, wherein the new slurry supply device stops supplying the new slurry, in a case where the concentration of the recycled slurry which the sensor measures is equal to or above a predetermined value, and the second pump supplies the recycled slurry to the chemical-mechanical polishing apparatus, after the slurry is completely recycled.

According to the present invention, after the slurry is completely recycled, the recycled slurry is supplied to the chemical-mechanical polishing apparatus. In other words, the recycled slurry having a concentration with an optimum value is supplied to the chemical-mechanical polishing apparatus, the process for polishing a to-be-polished object is performed with a predetermined degree of accuracy.

The slurry recycling apparatus for the CMP technique may further comprise:

a first tank which contains the used slurry collected by the first pump; and a mixer which is arranged in the first tank, wherein the new slurry supply device supplies the new slurry into the first tank, the mixer produces the recycled slurry by mixing the used slurry with the new slurry supplied in to the first tank, and the second pump supplies the recycled slurry contained in the first tank to the chemical-mechanical polishing apparatus, after the slurry is completely recycled.

The slurry recycling apparatus for a CMP technique may further comprise:

a first filtration unit which removes unnecessary components from the used slurry collected by the first pump; and a second filtration unit which re moves unnecessary components from the recycled slurry supplied to the chemical-mechanical polishing apparatus.

The slurry recycling apparatus for a CMP technique may further include a chemical component supply device which supplies, into the tank, chemical components for recycling the used slurry.

The slurry recycling apparatus for a CMP technique may further include:

at least one second tank;

a first valve which selects a predetermined tank containing the used slurry collected by the first pump, from the first tank and the at least one second tank, and which conducts the used slurry to the predetermined tank; and a second valve which selects a predetermined tank into which the new slurry is supplied by the new slurry supply device, from the first tank and the at least one second tank, and which conducts the new slurry to the predetermined tank, wherein the mixer produces the recycled slurry in at least one of the first tank and the at least one second tank, the first pump collects the used slurry in at least one of the first tank and the at least one second tank, in which the recycled slurry is not being produced by the mixer.

The slurry recycling apparatus for a CMP technique may further comprise a chemical-mechanical polishing apparatus which polishes a to-be-polished object.

The slurry recycling apparatus for a CMP technique may further comprise:

a first tank a tube which conducts used slurry collected by the first pump to the first tank; and a third pump which forms a circulation path between the first tank and the tube, wherein the new slurry supply device supplies the new slurry to the used slurry which flows into the tube, the third pump produces the recycled slurry by causing the used slurry and the new slurry to circulate between the first tank and the tube, and the second pump supplies the recycled slurry contained in the first tank to the chemical-mechanical polishing apparatus, after the slurry is completely recycled.

The slurry recycling apparatus for a CMP technique may further comprise a chemical component supply device which supplies chemical components for recycling the used slurry to the used slurry which flows into the tube.

The slurry recycling apparatus for a CMP technique may further comprise:

at least one second tank;

a first valve which selects a predetermined tank into which the used slurry collected by the first pump is supplied, from the first tank and the at least one second tank, and which conducts the used slurry to the predetermined tank;

a second valve which selects at least one of the first tank and the at least one second tank, through which the used slurry and the new slurry are caused to circulate by the third pump; and a third valve which selects a predetermined tank containing the recycled slurry which the second pump supplies to the chemical-mechanical polishing apparatus, wherein the second pump supplies, to the chemical-mechanical polishing apparatus, the recycled slurry contained in at least one of the first tank and the at least one second tank, and the third pump produces the recycled slurry by causing the used slurry and the new slurry to circulate between the tube and at least one tank from which the recycled slurry is not being supplied by the second pump.

The slurry recycling apparatus for a CMP technique may further comprise a chemical-mechanical polishing apparatus which polishes a to-be-polished object.

According to the second aspect of the present invention, there is provided a slurry recycling method for a CMP technique, comprising:

collecting used slurry employed for a CMP technique, from a CMP apparatus;

supplying, to the used slurry, new slurry having a concentration higher than a concentration of the used slurry;

producing recycled slurry by mixing the used slurry and the new slurry;

measuring a concentration of the recycled slurry; and supplying the recycled slurry to the CMP apparatus, wherein the supplying the new slurry includes stopping supplying the new slurry, in a case where a concentration of the recycled slurry is equal to or above a predetermined value, and the supplying the recycled slurry includes supplying the recycled slurry to the chemical-mechanical polishing apparatus, in a case where the slurry is completely recycled.

According to this invention, after the slurry is completely recycled, the recycled slurry is supplied onto the chemical-mechanical polishing apparatus. Only the recycled slurry satisfactorily having a predetermined value (optimum value) is supplied onto the chemical-mechanical polishing apparatus, therefore, a polishing process can be performed with a predetermined degree of accuracy.

The slurry recycling method for a CMP technique may further comprise:

removing unnecessary components from the collected used slurry; and removing unnecessary components from the recycled slurry which is supplied to the chemical-mechanical polishing apparatus.

The slurry recycling method for a CMP technique may further comprise supplying chemical components for recycling the used slurry to the used slurry.

The producing the recycled slurry may include producing the recycled slurry in at least one of a plurality of tanks.

The collecting the used slurry may include collecting the used slurry in at least one tank, in which the recycled slurry is not being produced.

The supplying the recycled slurry may include supplying the recycled slurry from at least one of a plurality of tanks, to the CMP apparatus.

The producing the recycled slurry may include producing the recycled slurry in at least one tank, from which the recycled slurry is not being supplied.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A slurry recycling apparatus for a CMP technique according to the first embodiment of the present invention will now be described with reference to the accompanying drawings.

Figure 1:
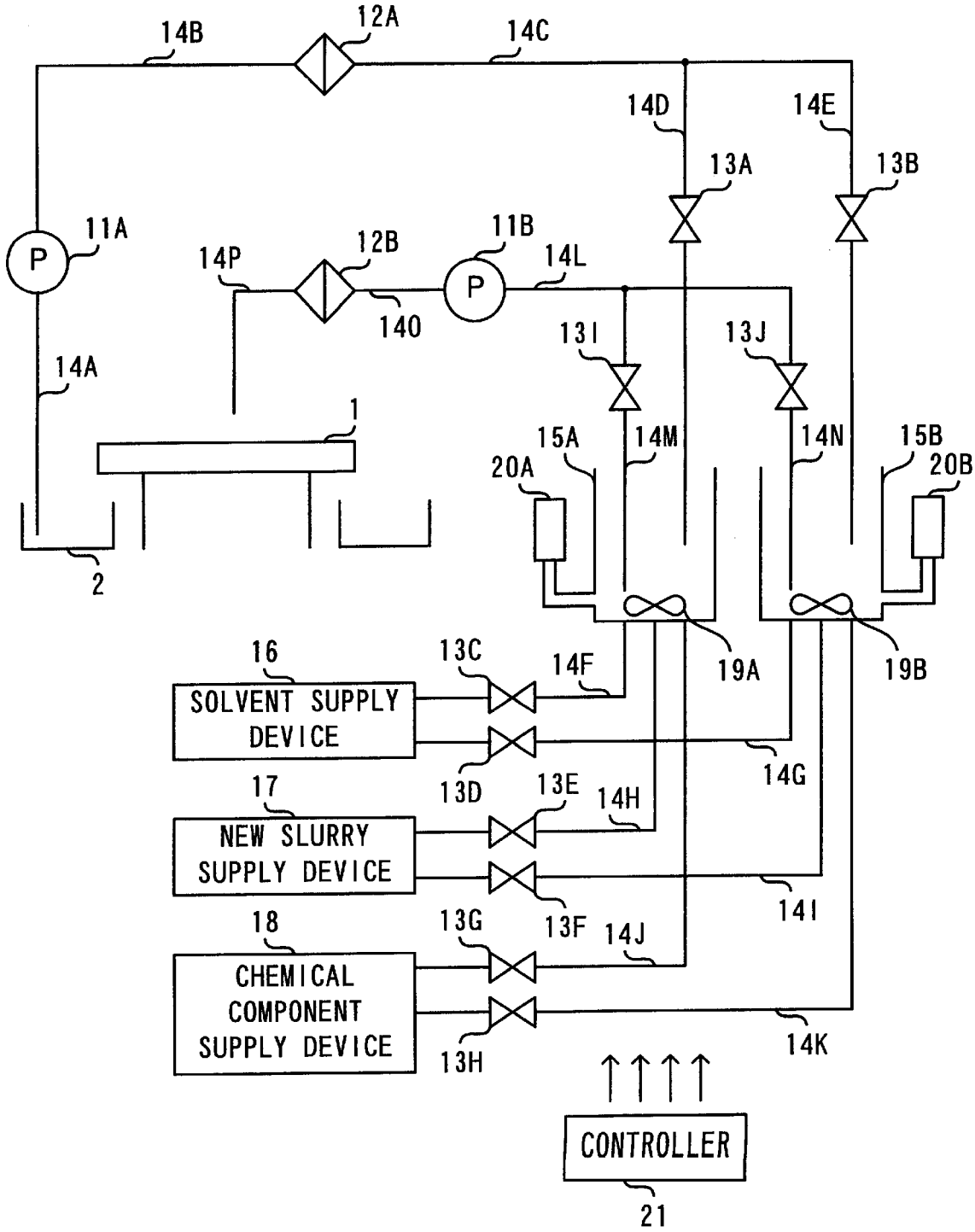
FIG. 1 is a diagram showing a structure of a slurry recycling apparatus for a CMP technique according to the first embodiment of the present invention.

FIG. 1 is a diagram showing a structure of the slurry recycling apparatus for a CMP technique according to the first embodiment of the present invention.

As illustrated in FIG. 1, the slurry recycling apparatus for the CMP technique comprises a polishing table 1, a fluid bath 2, pumps 11A, 11B, filters 12A, 12B, valves 13A to 13J, tubes 14A to 14P, collection tanks 15A, 15B, a solvent supply device 16, a new slurry supply device 17, a chemical component supply device 18, mixers 19A, 19B, analyzers 20A, 20B and a controller 21.

The polishing table 1 is a table on which a to-be-polished object, such as a semiconductor wafer and the like, is placed.

The fluid bath 2 is arranged underneath the periphery of the polishing table 1 so that used slurry dripped from the polishing table 1 remains therein.

The pump 11A is connected both to the tubes 14A and 14B and draws the used slurry from the fluid bath 2 through the tube 14A. The pump 11A supplies the drawn slurry to the filter 12A through the tube 14B.

The filter 12A is connected both to the tubes 14B and 14C, and filters the used slurry which has been supplied from the pump 11A via the tube 14B, so as unnecessary components to be isolated from the used slurry. Particularly, the filter 12A isolates the unnecessary components each having a relatively large diameter, from the used slurry. The filter 12A supplies, to the tube 14C, the filtered used slurry in which the unnecessary components are not included.

The tube 14C is joined both with the tubes 14D and 14E, so that the channels along which the used slurry supplied to the tube 14C flows are divided by two.

The tubes 14D and 14E conduct the used slurry to the collection tanks 15A and 15B, respectively.

The valves 13A and 13B are arranged on the course of the tubes 14D and the 14E, respectively, and adjust a flow rate of the used slurry to be supplied to the collection tanks 15A and 15B.

Since the solvent supply device 16 is connected both to the collection tanks 15A and 15B via the tubes 14F and 14G, it supplies pure water thereto via the tubes 14F and 14G.

The valves 13C and 13D are arranged on the course of the tubes 14F and 14G, respectively, and adjust a flow rate of the pure water to be supplied to the collection tanks 15A and 15B.

Since the new slurry supply device 17 is connected both to the collection tanks 15A and 15B via the tubes 14H and 14I, it supplies new slurry having a higher concentration than that of the used slurry to the collection tanks 15A and 15B via the tubes 14H and 14I.

The valves 13E and 13F are arranged on the course of the tubes 14H and 14I, and adjust a flow rate of the new slurry to be supplied to the collection tanks 15A and 15B.

The chemical component supply device 18 is connected to the collection tanks 15A and 15B via the tubes 14J and 14K. The chemical component supply device 18 supplies a chemical component necessary to recycle the used slurry to the collection tanks 15A and 15B via the tubes 14J and 14K. Such chemical component used to recycle the used slurry is, for example, a surface-active agent, an aggregation inhibitor or the like.

The valves 13G and 13H are arranged respectively on the course of the tubes 14J and 14K, and adjust a flow rate of the chemical component to be supplied to the collection tanks 15A and 15B.

The mixers 19A and 19B are arranged inside the collection tanks 15A and 15B, respectively, so as to mix the used slurry, pure water, new slurry and chemical components all of which are supplied into the collection tanks 15A and 15B. Thus, the slurry in which chemical components are uniformly contained is recycled.

The analyzers 20A and 20B are connected to the collection tanks 15A and 15B, respectively, and analyze the slurry (recycled slurry) which has been recycled inside the collection tanks 15A and 15B by measuring the concentration thereof.

The pump 11B is joined both with the tube 14O and the tube 14L which is joined both with the tubes 14M and 14N. The pump 11B draws the recycled slurry, which has been recycled inside the collection tank 15A, through the tubes 14L and 14M and supplies the drawn slurry to the tube 14O. Similarly, the pump 11B draws the recycled slurry, which has been recycled inside the collection tank 15B, through the tubes 14L and 14N and supplies the drawn slurry to the tube 14O.

The valves 13I and 13J are arranged on the course of the tubes 14M and 14N, respectively, and adjust a flow rate of the recycled slurry to be drawn by the pump 11B from the collection tanks 15A and 15B.

The filter 12B is joined both with the tubes 14O and 14P and filters the recycled slurry which has been supplied from the pump 11B via the tube 14O, so as unnecessary components to be isolated from the recycled slurry. Particularly, the filter 12B isolates, from the recycled slurry, such unnecessary components that are not isolated by the filter 12A owing to their relatively small diameter. The filter 12B supplies, to the polish table 1 via the tube 14P, the recycled slurry which has been filtered.

The controller 21 controls the above-described operations which are processed within the slurry recycling apparatus for the CMP technique, in accordance with a program which is provided from a recording medium or which is provided from a computer via a network, etc.

As explained above, there are provided two sections (collection tanks 15A and 15B) in which slurry is recycled, therefore, the slurry can be continuously and stabilizingly recycled (prepared).

Operations of the above-described slurry recycling apparatus for the CMP technique will now be described.

Figure 2:
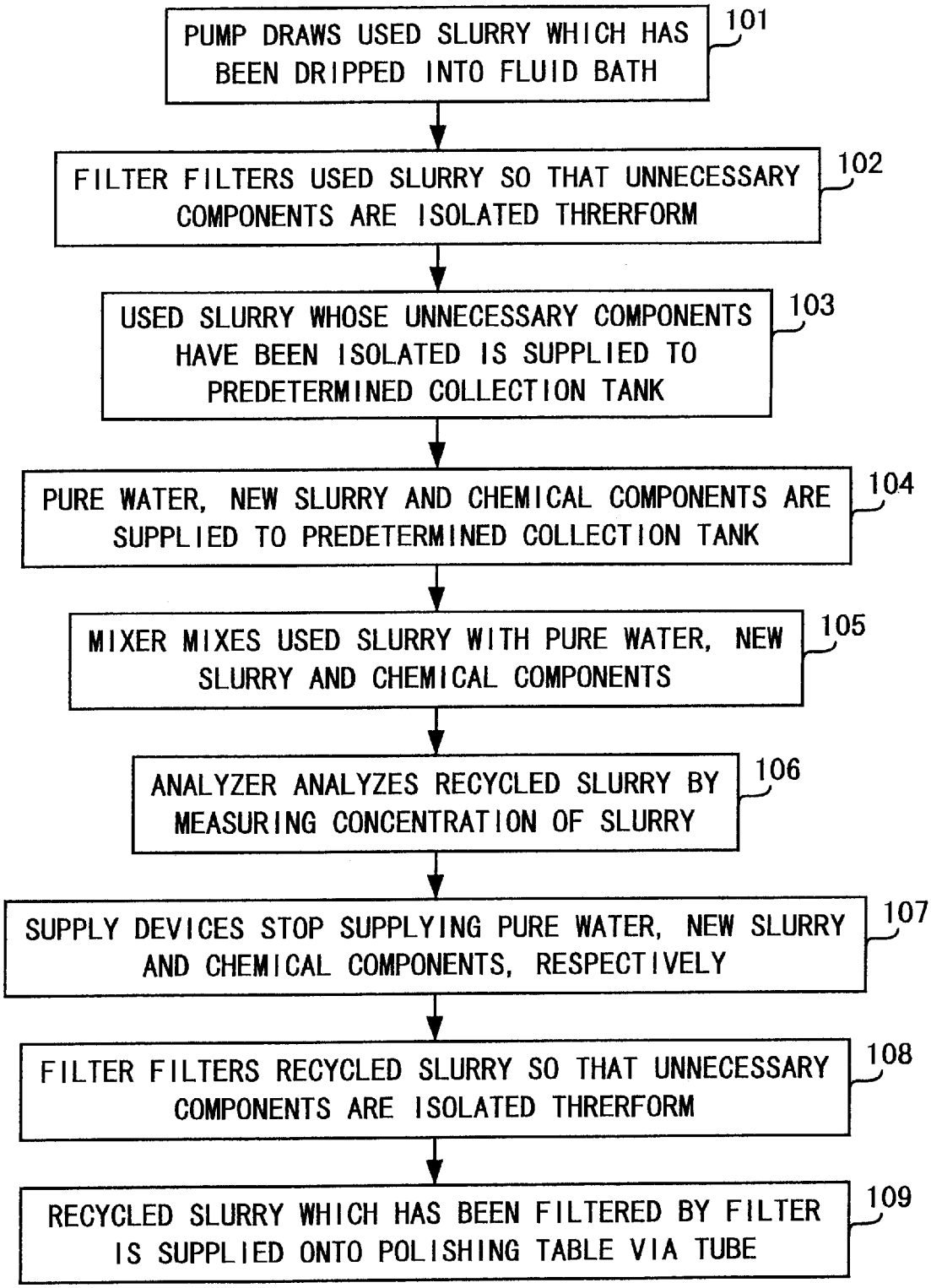
FIG. 2 is a flowchart illustrating operations of the slurry recycling apparatus for the CMP technique, shown in FIG. 1.

FIG. 2 is a flowchart illustrating operations of the slurry recycling apparatus for the CMP technique. Though omitted below, it should be assumed that the controller 21 controls operations processed by each section within the slurry recycling apparatus for the CMP technique.

First, a to-be-polished object is placed on the polishing table 1 onto which slurry is supplied so as the object to be polished. The slurry which has been used to polish the object drips into the fluid bath 2 from the polishing table 1.

The pump 11A draws the used slurry which has been dripped into the fluid bath 2, via the tube 14A, so that the drawn slurry is collected (Step 101). The pump 11A supplies the used slurry to the filter 12A via the tube 14B.

The filter 12A filters the used slurry supplied from the pump 11A so as unnecessary components each having a relatively large diameter to be isolated therefrom (Step 102).

In this case, either one of the valves 13A and 13B, for example the valve 13A, opens in order to release the used slurry without including the unnecessary components to either one of the collection tanks 15A and 15B. The used slurry whose unnecessary components have been isolated is supplied to, for example, the collection tank 15A, via the tubes 14C and 14D (Step 103).

If the collection tank 15A is filled with a predetermined amount of slurry, the valve 13A closes, whereas the valve 13B opens, so that the used slurry collected from the fluid bath 2 is supplied to the collection tank 15B.

In such a case where the collection tank 15A is filled with the predetermined amount of used slurry, the valves 13C, 13E and 13G open.

The solvent supply device 16 supplies pure water to the collection tank 15A via the tube 14F. The new slurry supply device 17 supplies new slurry to the collection tank 15A via the tube 14H. The chemical component supply 18 supplies chemical components to the collection tank 15A via the tube 14J (Step 104).

In such a case where the pure water, new slurry, chemical components begin to be supplied thereto, the mixer 19A mixes the used slurry which is supplied into the collection tank 15A, together with the pure water, new slurry and chemical components (Step 105).

The analyzer 20A measures the concentration of the slurry in the collection tank 15A. (Step 106).

If the concentration of the recycled slurry is equal to or above a predetermined value, the solvent supply device 16 stops supplying the pure water, the new slurry supply device 17 stops supplying the new slurry, and the chemical component supply device 18 stops supplying the chemical components (Step 107). Accordingly, the process for recycling the used slurry completes.

The valves 13C, 13E and 13G which have opened in order to supply the pure water, new slurry and chemical components, respectively, now close.

The pump 11B draws the recycled slurry which has been prepared within the collection tank 15A, via the tubes 14L and 14M, after the valve 13I opens. The pump 11B supplies the drawn recycled slurry to the filter 12B via the tube 14O.

The filter 12B filters the recycled slurry so that unnecessary components, which have not been isolated by the filter 12A, are isolated therefrom (Step 108).

The recycled slurry which has been filtered by the filter 12B is supplied onto the polishing table 1 via the tube 14P (Step 109). The pump 11B and the valve 13I adjust an amount of recycled slurry to be supplied onto the polishing table 1.

While the recycled slurry prepared within the collection tank 15A is being supplied onto the polishing table 1, the used slurry collected from the fluid bath 2 is supplied into the collection tank 15B. Similarly, the used slurry is recycled within the collection tank 15B.

Accordingly, the slurry having optimum chemical properties can be stabilizingly recycled, by measuring the concentration of the recycled slurry instead of the concentration of the used slurry. Following the slurry having optimum chemical properties is completely recycled, the recycled slurry is supplied to the polishing table 1, so that the process for polishing the to-be-polished object is preferably performed.

As described above, since there are provided two sections for recycling the used slurry (collection tanks 15A and 15B), the slurry having given chemical properties can be continuously recycled.

A slurry recycling apparatus for a CMP technique according to the second embodiment of the present invention will now be described with reference to the accompanying drawings.

In the slurry recycling apparatus for the CMP technique according to the second embodiment of the present invention, the method for supplying pure water, new slurry and chemical components all of which are used for recycling used slurry differs from the method therefor described in the first embodiment.

In the first embodiment, after the collection tank is filled with the predetermined amount of used slurry, pure water, new slurry and chemical components are supplied. The used slurry is mixed with those components so as to be recycled, while either one of the analyzers 20A and 20B measures the concentration of the slurry in the collection tank.

On the contrary, in the second embodiment of the present invention, pure water, new slurry and chemical components are primarily added, in a particular tube, to the used slurry to be supplied into a collection tank. The used slurry which has been supplied into the collection tank is supplied back to the tube while its concentration is being measured, so as to be recycled.

Figure 3:
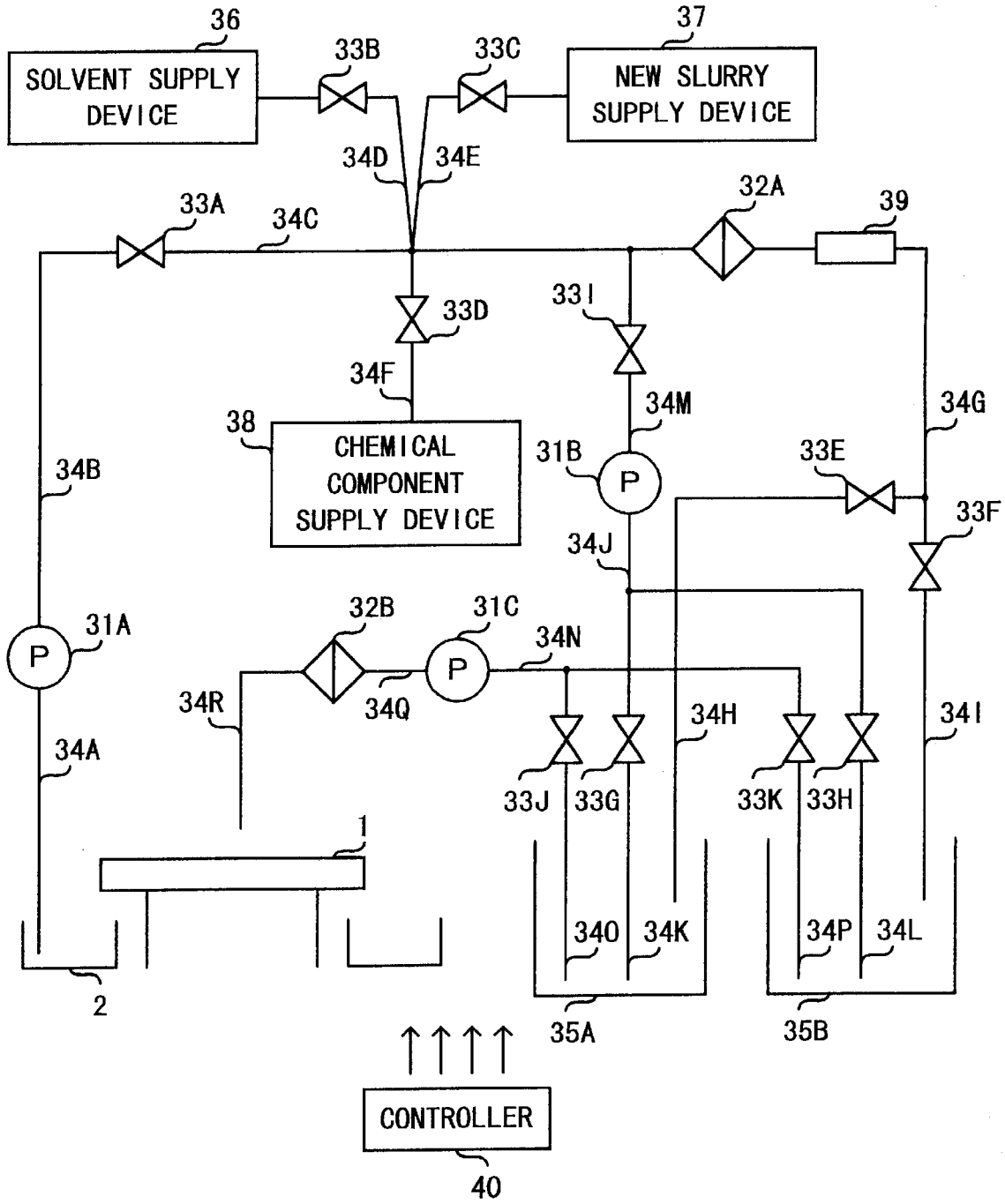
FIG. 3 is a diagram showing a structure of a slurry recycling apparatus for a CMP technique according to the second embodiment of the present invention.

FIG. 3 is a diagram showing a structure of a slurry recycling apparatus for a CMP technique according to the second embodiment of the present invention.

The slurry recycling apparatus for the CMP technique comprises a polishing table 1, a fluid bath 2, pumps 31A to 31C, filters 32A and 32B, valves 33A to 33K, tubes 34A to 34R, collection tanks 35A and 35B, a solvent supply device 36, a new slurry supply device 37, a chemical component supply device 38, an analyzer 39 and a controller 40.

The structures of the polishing table 1 and the fluid bath 2 are substantially identical with those of the first embodiment.

The pump 31A is connected both to the tubes 34A and 34B and draws used slurry from the fluid bath 2 via the tube 34A. The pump 31A supplies the drawn slurry to the tube 34B.

The valve 34A is joined both with the tubes 34B and 34C and adjusts a flow rate of the used slurry which flows in the direction from the tube 34B to the tube 34C.

The solvent supply device 36 is connected to the tube 34C via the tube 34D and supplies pure water to the tube 34C via the tube 34D.

The valve 33B is arranged on the course of the tube 34D and adjusts a flow rate of the pure water supplied by the solvent supply device 36.

The new slurry supply device 37 is connected to the tube 34C via the tube 34E and supplies, to the tube 34C via the tube 34E, new slurry having a higher concentration than that of the used slurry.

The valve 33C is arranged on the course of the tube 34E and adjusts a flow rate of the new slurry supplied by the new slurry supply device 37.

The chemical component supply device 38 is connected to the tube 34C via the tube 34F and supplies, to the tube 34C via the tube 34F, one or more chemical components (for example, a surface-active agent, an aggregation inhibitor or the like) for recycling the used slurry.

The valve 33D is arranged on the course of the tube 34F and adjusts a flow rate of the chemical component supplied by the chemical component supply device 38.

Accordingly, if the pure water, new slurry and chemical compositions are supplied to the tube 34C and added to the used slurry which flows along the tube 34C, the used slurry is recycled.

The filter 32A is connected to the tube 34C and filters recycled slurry supplied to the tube 34C so that unnecessary components contained in the recycled slurry are isolated. Particularly, the filter 32A isolates the unnecessary components each having a relatively large diameter, from the recycled slurry, and supplies the recycled slurry in which the isolated unnecessary components are not included, to a tube 34G.

The analyzer 39 is arranged on the course of the tube 34G and analyzes the recycled slurry which is supplied to the tube 34G by measuring its concentration, etc.

The tube 34G is joined both with the tubes 34H and 34I, so that the channels along which the recycled slurry supplied to the tube 34G flows are divided by two.

The tubes 34H and 34I conduct the recycled slurry to the collection tanks 35A and 35B, respectively.

The valves 33E and 33F are arranged on the course of the tubes 34H and 34I, respectively, and adjust a flow rate of the recycled slurry to be supplied to the collection tanks 35A and 35B.

The pump 31B is connected both to tube 34M and the tube 34J, which is joined both with the tubes 34K and 34L. The pump 31B draws the recycled slurry supplied into the collection tank 35A via the tubes 34J and 34K and supplies the drawn slurry to the tubes 34M. The pump 31B draws the recycled slurry supplied into the collection tank 35B via the tubes 34J and 34L and supplies the drawn slurry to the tube 34M.

The valves 33G and 33H are arranged on the course of the tubes 34K and 34L, respectively, and adjust a flow rate of the recycled slurry to be drawn by the pump 31B from the collection tanks 35A and 35B.

The valve 33I is arranged on the course of the tube 34M and adjusts a flow rate of the recycled slurry supplied to the tube 34M.

The tube 34M is joined with the tube 34C, so that the recycled slurry supplied by the pump 31B circulates through the slurry recycling apparatus in sequential order from the filter 32A, the analyzer 39, the collection tanks 35A, 35B and the pump 31B.

The pump 31C is connected both to the tube 34Q and the tube 34N, which is joined both with the tubes 34O and 34P.

The pump 31C draws the recycled slurry supplied into the collection tanks 35A, via the tubes 35N and 35O, and supplies the drawn slurry to the tube 34Q. The pump 31C draws the recycled slurry supplied into the collection tank 35B, via the tubes 34N and 34P, and supplies the drawn slurry to the tube 34Q.

The valves 33J and 33K are arranged on the course of the tubes 34O and 34P, respectively, and adjust a flow rate of the recycled slurry to be drawn by the pump 31C from the collection tanks 35A and 35B.

The filter 32B is connected both to the tubes 34Q and 34R and filters the recycled slurry supplied from the pump 31C, so that unnecessary components are isolated from the recycled slurry. Specifically, the filter 32B isolates such unnecessary components that are not isolated by the filter 32A owing to their relatively small diameters. The filter 32B supplies the recycled slurry in which unnecessary components are not contained to the polishing table 1 via the tube 34R.

The controller 40 controls the above-described operations which are processed by each section within the slurry recycling apparatus for the CMP technique, in accordance with a program which is provided from a recording medium or which is provided from a computer via a network, etc.

As explained above, there are provided two sections (collection tanks 35A, 35B) in which recycled slurry is collected, thus, the slurry can be continuously and stabilizingly recycled.

Operations of the slurry recycling apparatus, having the above-described structure, for the CMP technique will now be described.

Figure 4:
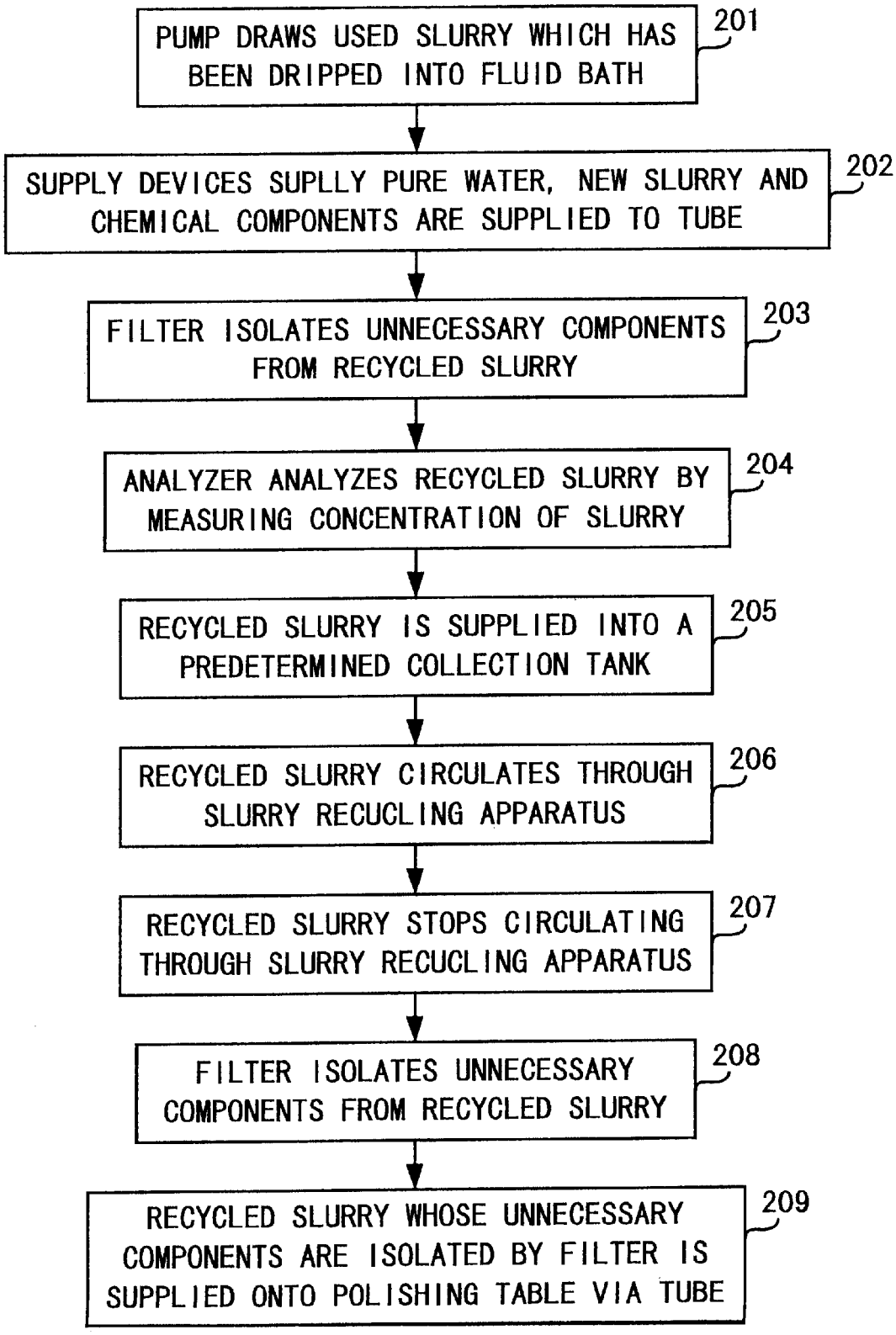
FIG. 4 is a flowchart showing operations of the slurry recycling apparatus for the CMP technique, shown in FIG. 3.
Figure 5:
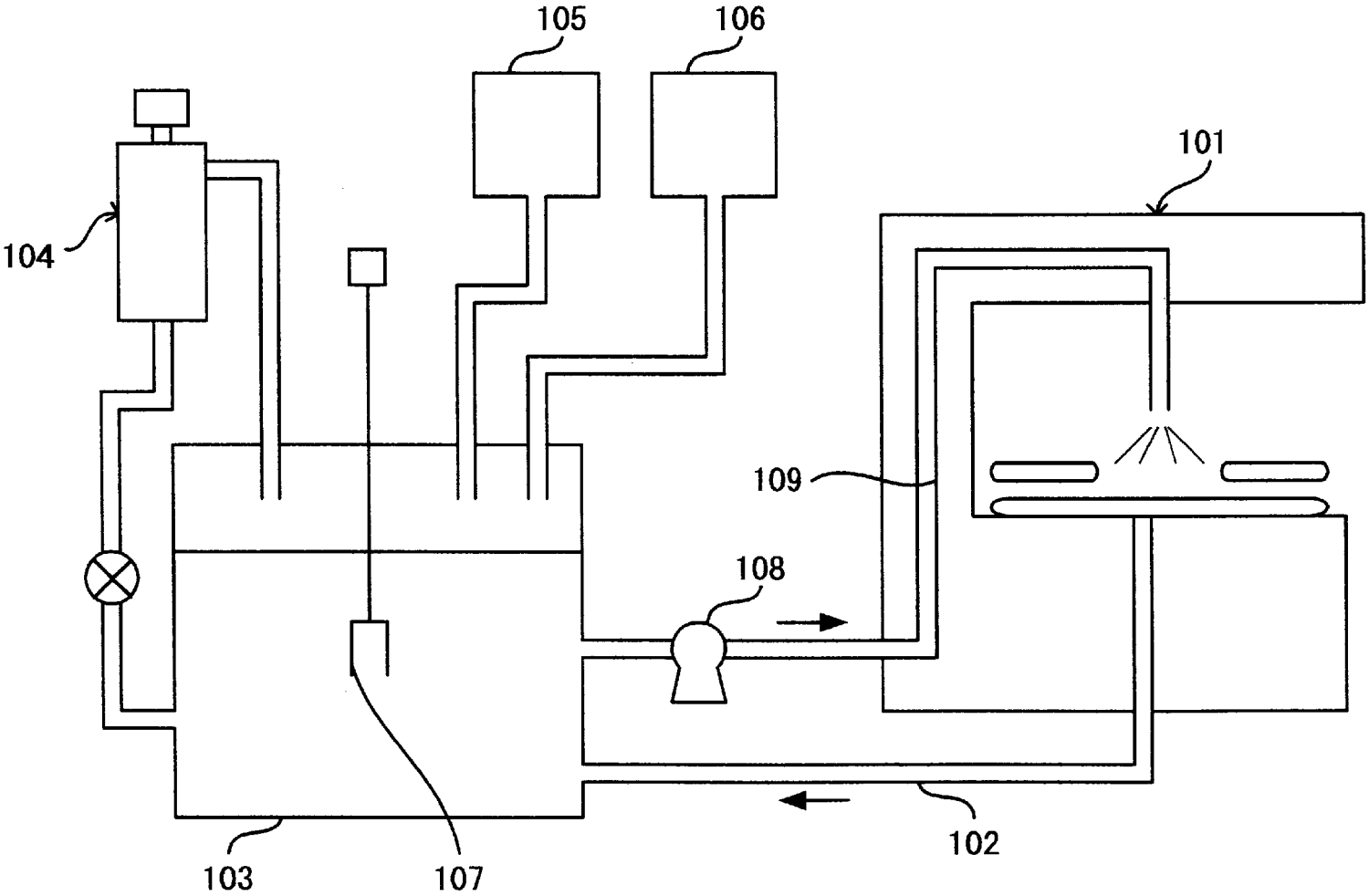
FIG. 5 (PRIOR ART)
FIG. 5 is a diagram exemplifying a conventional slurry recycling apparatus.
Figure 6:
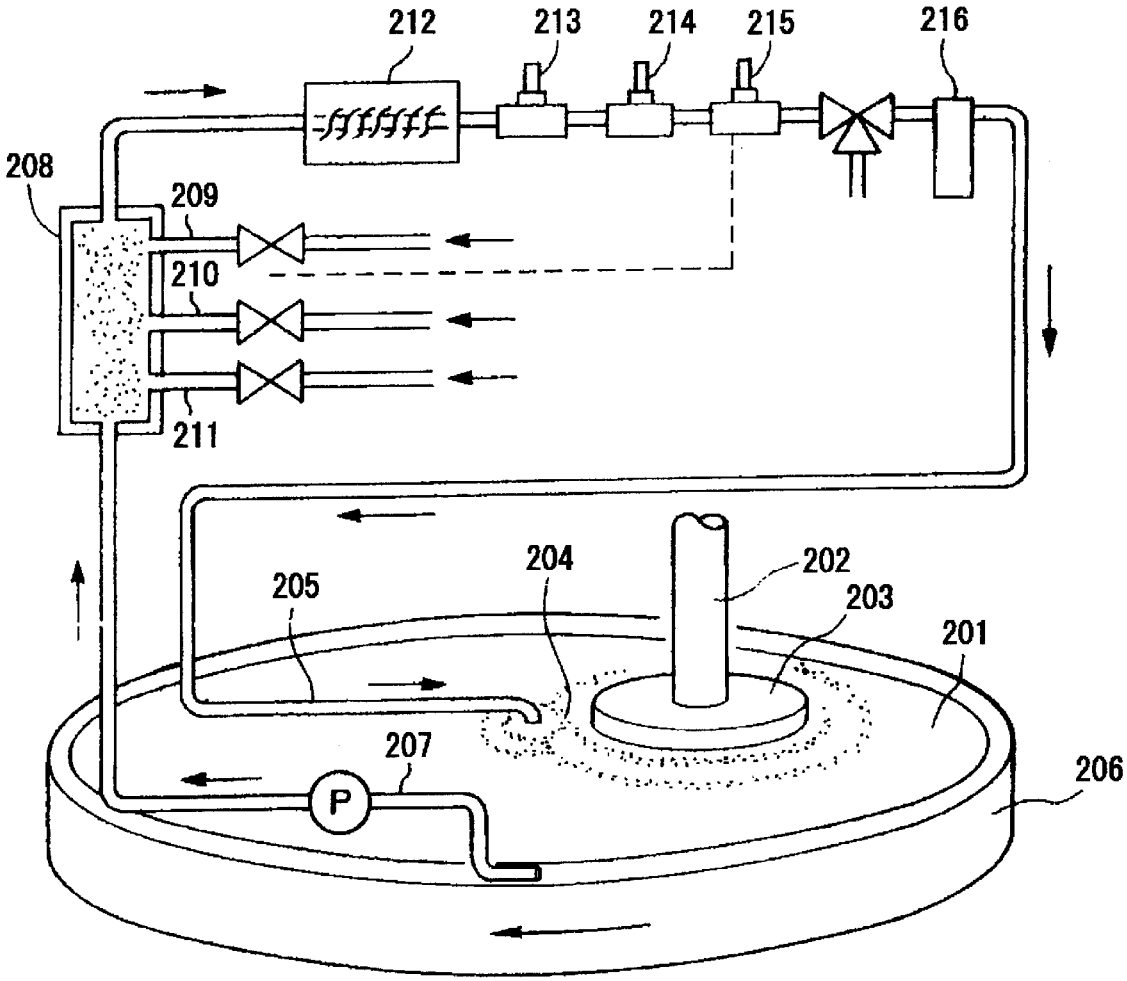
FIG. 6 (PRIOR ART)
FIG. 6 is a diagram exemplifying another conventional slurry recycling apparatus.

FIG. 4 is a flowchart illustrating operations of the slurry recycling apparatus for the CMP technique. Though omitted below, it should be assumed that the controller 40 controls operations processed by each section within the slurry recycling apparatus for the CMP technique.

First, a to-be-polished object is placed on the polishing table 1 onto which slurry is supplied so as the object to be polished. The slurry which has been used to polish the object drips into the fluid bath 2 from the polishing table 1.

The pump 31A draws the used slurry which has been dripped into the fluid bath 2, via the tube 34A, so that the drawn slurry is collected (Step 201). The pump 31A supplies the drawn slurry to the tube 34B.

The used slurry supplied to the tube 34B flows to the tube 34C while the valve 33A adjusts a flow rate thereof.

After the used slurry begins to flow toward the tube 34C, the valves 33B, 33C and 33D open.

The solvent supply device 36 supplies pure water to the tube 34C via the tube 34D. The new slurry supply device 37 supplies new slurry to the tube 34C via the tube 34E. The chemical component supply device 38 supplies chemical components to the tube 34C via the tube 34F (Step 202). As a result of this, the pure water, new slurry and chemical components are added to the used slurry in the tube 34C, resulting in recycling the used slurry. However, the chemical properties (such as its concentration and the like) of the slurry are not optimum for polishing the object.

The filter 32A isolates unnecessary components, each having a relatively large diameter, from the recycled slurry (Step 203), and supplies the filtered slurry to the tube 34G.

The analyzer 39 analyzes the recycled slurry supplied to the tube 34G by measuring its concentration, etc. (Step 204).

In this case, either one of the valves 33E and 33F, for example the valve 33E opens in order to release the recycled slurry whose unnecessary components are isolated to the collection tank 35A via the tubes 34G and 34H (Step 205).

When the recycled slurry begins to be supplied to the collection tank 35A, the valves 33G and 33I open.

The pump 31B draws the recycled slurry supplied into the collection tank 35A via the tubes 34J and 34K. The recycled slurry which is drawn by the pump 31B is supplied to the tube 34C via the tube 34M. In doing this, the recycled slurry circulates through the slurry recycling apparatus in sequential order from the filter 32A, the analyzer 39, the collection tank 35A and the pump 31B (Step 206). During the circulation of the recycled slurry, the analyzer 39 analyzes the chemical properties of the recycled slurry. The controller 40 controls the vales 33B, 33C and 33D in order to attain the concentration of the recycled slurry equal to or above a predetermined value, in accordance with an analyzed result of the analyzer 39.

If the concentration of the recycled slurry is equal to or above a predetermined value, the pump 31B stops drawing the recycled slurry, and the valves 33G and 33I close. Hence, the recycled slurry stops circulating (Step 207), and the collection tank 35A becomes filled with the recycled slurry having an optimum concentration.

If the collection tank 35A is filled with the recycled slurry, the valve 33E closes, whereas the valve 33F opens, whereby the recycled slurry is supplied to the collection tank 35B.

Following the collection tank 35A is filled with the recycled slurry, the valve 33J opens. The pump 31C draws the recycled slurry from the collection tank 35A via the tubes 34N and 34O and supplies the recycled slurry to the filter 32B via the tube 34Q.

The filter 32B isolates, from the recycled slurry, such unnecessary components that are not isolated by the filter 32A owing to their relatively small diameters (Step 208).

The recycled slurry whose unnecessary components are isolated by the filter 32B is supplied onto the polishing table 1 via the tube 34R (Step 209). It should noted that the valve 33J and the pump 31C adjust an amount of the recycled slurry to be supplied onto the polishing table 1.

While the recycled slurry prepared in the collection tank 35A is supplied onto the polishing table 1, the recycled slurry collected from the fluid bath 2 is supplied into the collection tank 35B. As described above, the recycled slurry circulates through the slurry recycling apparatus in sequential order from the filter 32A, the analyzer 39, the collection tank 35B and the pump 31B, and compounded so as its concentration, etc. to be equal to or above a predetermined value.

Accordingly, the slurry having optimum chemical properties can be stabilizingly recycled, by measuring the concentration of the recycled slurry instead of the concentration of the used slurry. Following the slurry having optimum chemical properties is completely recycled, the recycled slurry is supplied to the polishing table 1, so that the process for polishing the to-be-polished object is preferably performed.

As described above, since there are provided two sections for recycling the slurry (collection tanks 35A and 35B), the slurry having given chemical properties can be continuously recycled.

In the first and second embodiments, more than three collection tanks may be arranged as long as the apparatus has a structure in which the slurry can be continuously recycled as above.

The solvent supply device 36, new slurry supply device 37 and chemical component supply device 38 may be arranged in any position other than the above, as long as pure water, new slurry and chemical components are supplied and added to the recycled slurry which circulates through the apparatus.

Various embodiments and changes may be made thereonto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. H10-244124 filed on Aug. 28, 1998 and including specification, claims, drawings and summary. The disclosure of the above Japanese Patent Application is incorporated herein by reference in its entirety.

What is claimed is:

1. A slurry recycling apparatus for chemical-mechanical polishing (CMP) technique, comprising:

a first pump which collects used slurry employed for a CMP technique, from a chemical-mechanical polishing apparatus;

a new slurry supply device which supplies, to the used slurry, new slurry having a concentration higher than a concentration of the used slurry;

a sensor which measures a concentration of recycled slurry produced by mixing the used slurry with the new slurry; and a second pump which supplies the recycled slurry to the chemical-mechanical polishing apparatus, wherein said new slurry supply device stops supplying the new slurry, in a case where the concentration of the recycled slurry which said sensor measures is equal to or above a predetermined value, and said second pump supplies the recycled slurry to the chemical-mechanical polishing apparatus, after the slurry is completely recycled.

2. The slurry recycling apparatus for a CMP technique according to claim 1, further comprising:

a first tank which contains the used slurry collected by said first pump; and a mixer which is arranged in said first tank, wherein said new slurry supply device supplies the new slurry into said first tank, said mixer produces the recycled slurry by mixing the used slurry with the new slurry supplied into said first tank, and said second pump supplies the recycled slurry contained in said first tank to the chemical-mechanical polishing apparatus, after the slurry is completely recycled.

3. The slurry recycling apparatus for a CMP technique according to claim 2, further comprising:

a first filtration unit which removes unnecessary components from the used slurry collected by said first pump; and a second filtration unit which removes unnecessary components from the recycled slurry to be supplied to the chemical-mechanical polishing apparatus.

4. The slurry recycling apparatus for a CMP technique according to claim 3, further comprising a chemical component supply device which supplies, into said first tank, chemical components for recycling the used slurry.

5. The slurry recycling apparatus for a CMP technique according to claim 4, further comprising:

at least one second tank;

a first valve which selects a predetermined tank containing the used slurry collected by said first pump, from said first tank and said at least one second tank, and which conducts the used slurry to the predetermined tank; and a second valve which selects a predetermined tank into which the new slurry is supplied by said new slurry supply device, from said first tank and said at least one second tank, and which conducts the new slurry to the predetermined tank, wherein said mixer produces the recycled slurry in at least one of said first tank and said at least one second tank, said first pump collects the used slurry in at least one of said first tank and said at least one second tank, in which the recycled slurry is not being produced by said mixer.

6. The slurry recycling apparatus for a CMP technique according to claim 5, further comprising a chemical-mechanical polishing apparatus which polishes a to-be-polished object.

7. The slurry recycling apparatus for a CMP technique according to claim 1, further comprising:

a first tank;

a tube which conducts used slurry collected by said first pump to said first tank; and a third pump which forms a circulation path between said first tank and said tube, wherein said new slurry supply device supplies the new slurry to the used slurry which flows into said tube, said third pump produces the recycled slurry by causing the used slurry and the new slurry to circulate between said first tank and said tube, and said second pump supplies the recycled slurry contained in said first tank to the chemical-mechanical polishing apparatus, after the slurry is completely recycled.

8. The slurry recycling apparatus for a CMP technique according to claim 7, further comprising a chemical component supply device which supplies chemical components for recycling the used slurry to the used slurry which flows into said tube.

9. The slurry recycling apparatus for a CMP technique according to claim 8, further comprising:

at least one second tank;

a first valve which selects a predetermined tank into which the used slurry collected by said first pump is supplied, from said first tank and said at least one second tank, and which conducts the used slurry to the predetermined tank;

a second valve which selects at least one of said first tank and said at least one second tank, through which the used slurry and the new slurry are caused to circulate by said third pump; and a third valve which selects a predetermined tank containing the recycled slurry which said second pump supplies to the chemical-mechanical polishing apparatus, wherein said second pump supplies, to the chemical-mechanical polishing apparatus, the recycled slurry contained in at least one of said first tank and said at least one second tank, and said third pump produces the recycled slurry by causing the used slurry and the new slurry to circulate between said tube and at least one tank from which the recycled slurry is not being supplied by said second pump.

10. The slurry recycling apparatus for a CMP technique according to claim 9, further comprising a chemical-mechanical polishing apparatus which polishes a to-be-polished object.

11. A slurry recycling method for a CMP technique, comprising:

collecting used slurry employed for a CMP technique, from a CMP apparatus;

supplying, to the used slurry, new slurry having a concentration higher than a concentration of the used slurry;

producing recycled slurry by mixing the used slurry and the new slurry;

measuring a concentration of the recycled slurry; and supplying the recycled slurry to the CMP apparatus, wherein said supplying the new slurry includes stopping supplying the new slurry, in a case where a concentration of the recycled slurry is equal to or above a predetermined value, and said supplying the recycled slurry includes supplying the recycled slurry to the chemical-mechanical polishing apparatus, in a case where the slurry is completely recycled.

12. The slurry recycling method for a CMP technique according to claim 11, further comprising:

removing unnecessary components from the collected used slurry; and removing unnecessary components from the recycled slurry which is supplied to the chemical-mechanical polishing apparatus.

13. The slurry recycling method for a CMP technique according to claim 12, further comprising supplying chemical components for recycling the used slurry to the used slurry.

14. The slurry recycling method for a CMP technique according to claim 13, wherein:

said producing the recycled slurry includes producing the recycled slurry in at least one of a plurality of tanks; and said collecting the used slurry includes collecting the used slurry in at least one tank, in which the recycled slurry is not being produced.

15. The slurry recycling method for a CMP technique according to claim 13, wherein:

said supplying the recycled slurry includes supplying the recycled slurry from at least one of a plurality of tanks, to the CMP apparatus; and said producing the recycled slurry includes producing the recycled slurry in at least one tank, from which the recycled slurry is not being supplied.

* * * * *